US005344590A

United States Patent [19]

Carter et al.

[11] Patent Number: 5,344,590

[45] Date of Patent: Sep. 6, 1994

[54] METHOD FOR INHIBITING CORROSION OF METALS USING POLYTARTARIC ACIDS

[75] Inventors: Charles G. Carter, Silver Spring, Md.; Lai-Duien G. Fan; Joseph C. Fan, both of Lake Zurich, Ill.; Robert P. Kreh, Jessup; Vladimir Jovancicevic, Columbia, both of Md.

[73] Assignee: W. R. Grace & Co.-Conn., New York, N.Y.

[21] Appl. No.: 2,356

[22] Filed: Jan. 6, 1993

[51] Int. Cl.[5] ..... C23F 11/12

[52] U.S. Cl. ..... 252/396; 252/180; 252/389.61; 252/389.62; 210/698; 422/17

[58] Field of Search ..... 252/396, 180, 389.61, 252/389.62; 422/17; 210/698

[56] References Cited

U.S. PATENT DOCUMENTS

| | | | |
|---|---|---|---|
| 3,463,730 | 8/1969 | Booth et al. | 210/701 |
| 3,696,044 | 10/1972 | Rutledge et al. | 252/180 |
| 3,769,223 | 10/1973 | Pearson et al. | 252/174.19 |
| 3,856,755 | 12/1974 | Vogt et al. | 210/698 X |
| 4,304,707 | 12/1981 | Kuehn | 252/396 X |
| 4,384,979 | 5/1983 | Hansen | 210/697 X |
| 4,457,847 | 7/1984 | Lorenc et al. | 210/698 |
| 4,561,982 | 12/1985 | Kuriyama et al. | 210/698 |
| 4,654,159 | 3/1987 | Bush et al. | 252/174.19 |
| 4,663,071 | 5/1987 | Bush et al. | 252/174.19 |
| 4,673,508 | 6/1987 | Coleman et al. | 210/698 |
| 4,687,592 | 8/1987 | Collins et al. | 252/99 |
| 4,846,650 | 7/1989 | Benedict et al. | 424/55 |
| 4,896,650 | 7/1989 | Benedict et al. | 424/55 |
| 4,936,987 | 6/1990 | Persinski et al. | 210/699 |
| 4,937,002 | 6/1990 | Bainbridge et al. | 210/701 |
| 5,062,962 | 11/1991 | Brown et al. | 210/698 |
| 5,135,681 | 8/1992 | Carter et al. | 422/17 |
| 5,139,702 | 8/1992 | Carter et al. | 422/17 |

FOREIGN PATENT DOCUMENTS 4166298 6/1992 Japan .

*Primary Examiner*—Richard D. Lovering
*Assistant Examiner*—Valerie Fee
*Attorney, Agent, or Firm*—James P. Barr

[57] ABSTRACT

A method for inhibiting corrosion of metals in contact with an aqueous solution comprising adding to the system a corrosion inhibiting amount of one or more polytartaric acid compounds having the generalized formula:

wherein each R is independently selected from the group consisting of H and $C_1$ to $C_4$ alkyl, n is less than 4 and the average molecular weight of the mixture corresponds to an average n in the range 1.2 to 3.

12 Claims, 2 Drawing Sheets

METHOD FOR INHIBITING CORROSION OF METALS USING POLYTARTARIC ACIDS

FIELD OF THE INVENTION

This invention relates to a method for controlling corrosion in aqueous systems, and more particularly to the use of certain low molecular weight polytartaric acid compounds which are effective for controlling or inhibiting corrosion of metals which are in contact with aqueous systems.

BACKGROUND OF THE INVENTION

It is known that various dissolved materials which are naturally or synthetically occurring in aqueous systems, especially aqueous systems using water derived from natural resources such as seawater, rivers, lakes and the like, attack metals. Typical aqueous systems having metal parts which are subject to corrosion include circulating water systems such as evaporators, single and multi-pass heat exchangers, cooling towers, and associated equipment and the like. As the circulating water passes through or over the system, a portion of the system water evaporates thereby increasing the concentration of the dissolved materials contained in the system. These materials approach and reach a concentration at which they may cause severe pitting and corrosion which eventually requires replacement of the metal parts. Various corrosion inhibitors have been previously used to treat these systems.

For example, chromates, inorganic phosphates and/or polyphosphates have been used to inhibit the corrosion of metals which are in contact with water. The chromates, though effective, are highly toxic and consequently present handling and disposal problems. While phosphates are non-toxic, due to the limited solubility of calcium phosphate, it is difficult to maintain adequate concentrations of phosphates in many aqueous systems. Polyphosphates are also relatively non-toxic, but tend to hydrolyze to form orthophosphate which in turn, like phosphate itself, can create scale and sludge problems in aqueous systems (e.g. by combining with calcium in the system to form calcium phosphate). Moreover, where there is concern over eutrophication of receiving waters, excess phosphate compounds can serve as nutrient sources. Borates, nitrates, and nitrites have also been used for corrosion inhibition. These too can serve as nutrients in low concentrations, and/or represent potential health concerns at high concentrations.

Environmental considerations have also recently increased concerns over the discharge of metal corrosion inhibitors such as zinc, which previously were considered acceptable for water treatment.

Much recent research has concerned development of organic corrosion inhibitors which can reduce reliance on the traditional inorganic inhibitors. Among the organic inhibitors successfully employed are organic phosphonates. These compounds may generally be used without detrimentally interfering with other conventional water treatment additives. However, environmental concerns about the discharge of phosphorus in the form of organic phosphonates have begun to be heard. It is anticipated that in the future this will lead to limitations on the use of organic phosphonates in water treatment.

Another serious problem in industrial aqueous systems, especially in cooling water systems, evaporators, and boilers is the deposition onto heat transfer surfaces of scale, particularly scale-forming salts such as certain carbonates, hydroxides, silicates and sulfates of cations such as calcium and magnesium. These systems contain relatively high concentrations of calcium carbonate, calcium sulfate and other hardness salts. Because of the evaporation which takes place in these aqueous systems, these salts in the water become more concentrated. Many organic corrosion inhibitors (e.g. hydroxyethylidene diphosphonic acid) are very sensitive to calcium i.e., they have a high tendency to precipitate with calcium ions in solution and are thus rendered ineffective.

Thus, there is a continuing need for safe and effective water treating agents which can be used to control corrosion, particularly when a substantial concentration of dissolved calcium is present in the system water. Water treating agents of this type are particularly advantageous when they are phosphorus-free.

SUMMARY OF THE INVENTION

Figure 1:
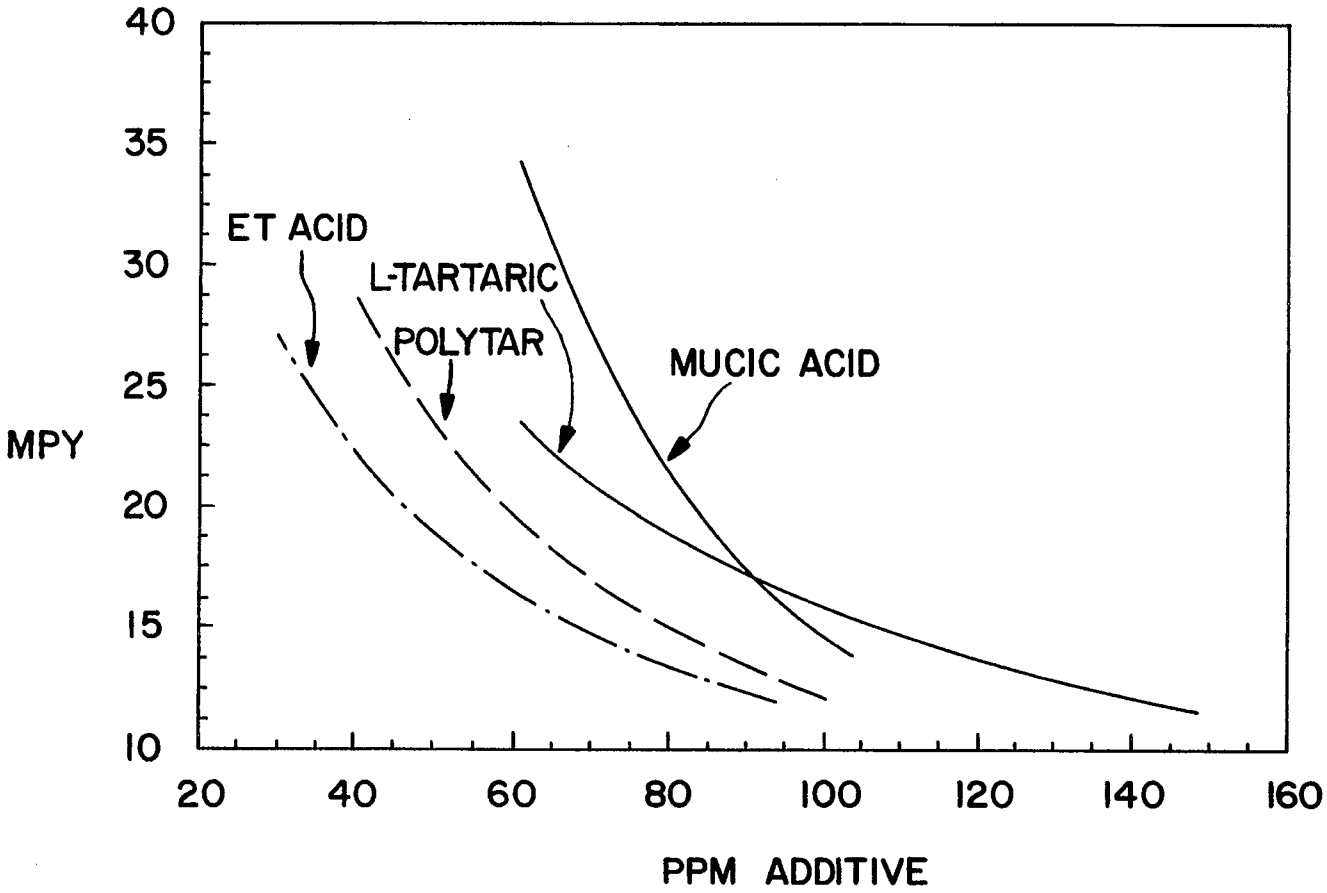
FIG. 1 illustrates the corrosion inhibiting activity vs. concentration of erythraric-tartaric acid (ET acid), polytartaric acid (POLYTAR), L-tartaric acid (L-TARTARIC) and mucic acid in high hardness waters.

It is an object of this invention to provide a method of inhibiting corrosion of metals which are in contact with an aqueous system.

It is another object to provide novel non-phosphorus containing organic corrosion inhibitors having high activity and low levels of toxicity.

In accordance with the present invention, there has been provided a method for inhibiting corrosion of metals which are in contact with an aqueous system comprising adding to the system a corrosion inhibiting amount of one or more polytartaric acids having the following generalized formula:

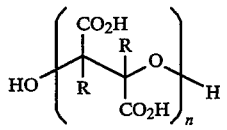

wherein each R is independently selected from the group consisting of H and $C_1$ to $C_4$ alkyl, n is less than 4, and the average molecular weight of the polytartaric acids corresponds to an average n in the range 1.2 to 3.

DETAILED DESCRIPTION

This invention is directed to the use of certain polytartaric acids as corrosion control agents for treating aqueous systems. The method of this invention comprises adding to an aqueous system, in an amount effective to inhibit corrosion of metals which are in contact with the aqueous system, one or more polytartaric acids having the following general formula:

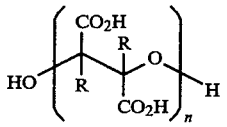

wherein each R is independently selected from the group consisting of H and $C_1$ to $C_4$ alkyl, n is less than 4, and the average molecular weight of the polytartaric acids corresponds to an average n in the range 1.2 to 3.

The polytartaric acids of the present invention may be prepared by reacting a cis- or trans-epoxysuccinic acid, or a $C_1$ to $C_4$ alkylated derivative thereof, with tartaric acid and calcium hydroxide. The resultant polytartaric acid reaction product will generally comprise a mixture of some residual unreacted monomeric cis- or trans-epoxysuccinic acid together with tartaric acid and dimers, trimers, etc. thereof. For purposes of inhibiting corrosion, it has been found that n in the above formula must be less than 4 and the mixture of polytartaric acids must have an average molecular weight greater than 233 and less than 731, preferably 250 to 600, most preferably 250 to 400 expressed as the sodium salt. These average molecular weight ranges, as determined by gel permeation chromatography, correspond to average values for n in the above general formula, in the range of from about 1.2 to 3, preferably from 1.4 to 2. The preferred polytartaric acids for use as corrosion inhibitors in accordance with this invention are the dimeric or trimeric form of polytartaric acid; i.e., wherein n is 2 or 3; and is more preferably a mixture of monomeric, dimeric and trimeric forms of tartaric/polytartaric acids respectively having an average molecular weight for the mixture in the above preferred ranges.

The polytartaric acids of this invention have been found to be surprisingly effective for inhibiting corrosion of metals which are in contact with aqueous systems. In accordance with the present invention, the corrosion of metals which are in contact with an aqueous system may be prevented or inhibited by adding to the system a corrosion inhibiting amount of one or more of the polytartaric acids of this invention, or their water soluble salts. The precise dosage of the corrosion inhibiting agents of this invention is not, per se, critical to this invention and depends, to some extent, on the nature of the aqueous system in which it is to be incorporated and the degree of protection desired. In general, the concentration of the polytartaric acids maintained in the system can range from about 0.05 to about 500 ppm. Within this range, generally low dosages of about 200 ppm or less are preferred, with a dosage of between 1 and 50 ppm being most preferred for many aqueous systems, such as for example, many open recirculating cooling water systems. The exact amount required with respect to a particular aqueous system can be readily determined by one of ordinary skill in the art in conventional manners. As is typical of most aqueous systems, the pH is preferably maintained at 7 or above, and is most preferably maintained at 8 or above.

It is considered an important feature of this invention, that the claimed compositions be calcium insensitive. Calcium sensitivity refers to the tendency of a compound to precipitate with calcium ions in solution. The calcium insensitivity of the claimed compositions permits their use in aqueous systems having water with relatively high hardness. The test for calcium insensitivity of a compound, as used in this application, involves a cloud point test (hereinafter the CA500 cloud point test) where the compound is added to hard water containing 500 ppm calcium ion (as $CaCO_3$) which is buffered at pH 8.3 using 0.005 M borate buffer and which has a temperature of 60° C. The amount of compound which can be added to the solution until it becomes turbid (the cloud point) is considered to be an indicator of calcium insensitivity.

The calcium insensitive compounds of this invention have cloud points of at least about 50 ppm as determined by the CA500 cloud point test, and preferably have cloud points of at least about 75 ppm, and most preferably have cloud points of at least 100 ppm as determined by the CA500 cloud point test.

In addition to being effective corrosion inhibitors when used as the sole corrosion inhibiting agent in the aqueous system, it has now been discovered that the polytartaric acids of this invention, when used in combination with a second water-soluble component selected from the group consisting of a tartaric acid, a phosphate, a phosphonate, a polyacrylate, an azole, or mixtures thereof, provide unexpectedly superior corrosion inhibition. As used herein, the terminology "water-soluble" refers to those compounds which are freely soluble in water as well as those compounds which are sparingly soluble in water or which may first be dissolved in a water-miscible solvent and later added to an aqueous system without precipitating out of solution. As used herein, tartaric acid includes, but is not limited to meso-tartaric acid, meta-tartaric acid, L-tartaric acid, D-tartaric acid, D,L-tartaric acid, and the like, and mixtures thereof. Suitable polyacrylates for use in this invention generally have molecular weights less than 10,000 and are preferably in the range of 1000 to 2000. Suitable azoles for use in this invention include benzotriazole and $C_1$ to $C_4$ alkyl, nitro, carboxy or sulfonic derivatives of benzotriazoles. Suitable phosphates include water soluble inorganic phosphates such as orthophosphates, triphosphates, pyrophosphates, hexaphosphates and the like, and mixtures thereof. Preferred phosphonates for use in this invention include hydroxyethylidene diphosphonic acid (HEDPA) or phosphonobutane tricarboxylic acid (PBTC).

Accordingly, another embodiment of this invention is directed to a method of inhibiting corrosion of metals in contact with an aqueous system comprising adding to the system one or more polytartaric acids, as hereinbefore defined, together with a tartaric acid, a phosphate, a phosphonate, a polyacrylate, an azole, or mixtures thereof in amounts effective to inhibit corrosion. The weight ratio of polytartaric acid to (tartaric acid, phosphate, phosphonate, polyacrylate, azole, or mixture thereof), employed herein is not, per se, critical to the invention and is of course determined by the skilled artisan for each and every case while taking into consideration the water quality and the desired degree of protection in the particular situation. A preferred weight ratio of polytartaric acid:(tartaric acid phosphate, phosphonate, polyacrylate, azole, or mixture thereof) on an actives basis is in the range of from 1:10 to 20:1 with a range of from 2:1 to 10:1 being most preferred.

The corrosion inhibiting compositions of this invention may be added to the system water by any convenient mode, such as by first forming a concentrated solution of the treating agent with water, preferably containing between 1 and 50 total weight percent of the active corrosion inhibitor, and then feeding the concentrated solution to the system water at some convenient point in the system. In many instances, the treatment compositions may be added to the make-up water or feed water lines through which water enters the system. For example, an injection calibrated to deliver a predetermined amount periodically or continuously to the make-up water may be employed.

The present invention is particularly useful for the treatment of cooling water systems which operate at temperatures between 60° F. and 200° F., particularly open recirculating cooling water systems which operate at temperatures of from about 80° F. to 150° F.

It will be appreciated that while the polytartaric acids and the combination of polytartaric acid/tartaric acid, phosphate, phosphonate, polyacrylates, azoles, or mixtures thereof, of this invention may be used as the sole corrosion inhibitor for the aqueous system, they may optionally be used in combination with other corrosion inhibitors as well as with other conventional water treatment compositions customarily employed in aqueous systems including, but not limited to, biocides, scale inhibitors, chelants, sequestering agents, dispersing agents, polymeric agents (e.g. copolymers of 2-acrylamido-2-methyl propane sulfonic acid and methacrylic acid or polymers of acrylic acid and methacrylic acid), and the like and mixtures thereof.

Without further elaboration, it is believed that one of skill in the art, using the preceding detailed description, can utilize the present invention to its fullest extent.

The following examples are provided to illustrate the invention in accordance with the principles of this invention, but are not to be construed as limiting the invention in any way except as indicated in the appended claims. All parts and percentages are by weight unless otherwise indicated.

EXAMPLE 1

Trans-epoxysuccinic acid

To a mixture of 11.6 g fumaric acid in 29 ml water was added 12.0 g of aqueous NaOH (50% by weight). This was followed by the addition of 13.6 ml of $H_2O_2$ (30%) and 0.66 g of sodium tungstate dihydrate dissolved in 5 ml of water. The reaction flask was heated and stirred in a 97° C. oil bath for 2 hours. The product was analyzed by NMR, giving 11.7% trans-epoxysuccinic acid by weight.

EXAMPLE 2

ET-Acid

To 7.2 g of the above product solution of trans-epoxysuccinic acid was added 0.96 g of L-Tartaric Acid and 1.43 g of aqueous NaOH (50% by weight). To this solution was added 0.48 g of lime, and the mixture was stirred and heated at 76° C. (internal temperature) for three hours. The product was analyzed by NMR, giving 15% by weight of erythraric-tartaric acid (ET-acid) with an average molecular weight of 270 as determined by GPC.

EXAMPLE 3

Cis-epoxysuccinic acid

A solution was prepared by dissolving 67 grams of sodium hydroxide in 400 ml of water. To this solution were added 130 g of maleic acid while maintaining the solution at a temperature below 98° C. An aqueous solution of hydrogen peroxide (30%) was then added, followed by the addition of a solution containing 2.0 g of sodium tungstate dihydrate in 8.0 ml of water. The solution was heated in a 90° C. oil bath for 30 minutes and then cooled to ≦60° C. A solution containing 44 g of aqueous NaOH (50% by weight) was then added to bring the pH to 7.0. The product was analyzed by NMR, giving 14.7% by weight of cis-epoxysuccinic acid and 3.9% by weight of D,L-tartaric acid.

EXAMPLE 4

Polytartaric Acid

To 13.5 g of the product from Example 3 was added 1.73 g of L-tartaric acid, 0.92 g of NaOH and 1.1 g of lime. The mixture was stirred and heated at 80° C. (internal temperature) for 3 hours. The product was analyzed by NMR, giving 22.7% by weight of polytartic acid.

EXAMPLE 5

A number of polytartaric acid samples were prepared according to Example 4, but with varying amounts of L-tartartic acid to produce products with different molecular weight distributions. Table 1 lists these products along with their average n values ($\bar{n}$), average molecular weights and distribution of oligomers, as determined by gel permeation chromatography. Tartaric acid is also included for comparison.

TABLE 1

| Characterization of Polytartaric Samples | | | | | | |
|---|---|---|---|---|---|---|
| | | Percent by Weight of Different Oligomers | | | | |
| Mw (±10%) | $\bar{n}$ | Monomer | Dimer | Trimer | Tetramer | >Tetramer |
| 194 | 1 | 100% | 0 | 0 | 0 | 0 |
| 265 | 1.4 | 61 | 32 | 6 | 1 | 0 |
| 335 | 1.8 | 42 | 34 | 19 | 5 | 0 |
| 390 | 2.0 | 0 | 100 | 0 | 0 | 0 |
| 530 | 2.9 | 23 | 23 | 27 | 25 | 3 |
| 731 | 4 | 9 | 7 | 7 | 40 | 37 |

EXAMPLE 6

The samples from Example 5 were tested for corrosion inhibition and, for comparison, for scale inhibition as follows:

Corrosion Inhibition

Test water was prepared to simulate that found in cooling water systems. The water contained 594 parts per million (ppm) $CaSO_4$, 78 ppm $CaCl_2$, 330 ppm $MgSO_4$ and 352 ppm $NaHCO_3$. The additives listed in Table 2 were added to separate aliquots (900 ml) of the test water to give a concentration of 80 ppm, except for the blank which contained no additive. These solutions were then adjusted to pH=8.5 with NaOH(aq) or $H_2SO_9$. A clean, preweighed SAE 1010 mild steel specimen was suspended in each test solution, which was stirred at 55° C. for 24 hours. The mild steel specimens were then cleaned, dried under vacuum at 60° C. and weighed. The corrosion rates, expressed in mils (thousandths of an inch) per year (mpy) were determined from this weight loss. These results are listed in Table 2 for each additive. During the corrosion tests listed in Table 2, all of the polytartaric acid samples provided greater pitting inhibition than the L-tartaric acid sample (i.e., wherein n =1).

Scale Inhibition as $CaCO_3$, Threshold Inhibition Procedure

The ability of polytartaric acid to inhibit calcium carbonate scale precipitation was measured using the following procedure: 800 ml of a test solution containing 1,000 ppm calcium and 328 ppm bicarbonate (both as $CaCO_3$) in a 1,000 ml beaker was stirred while heating to a temperature of 49° C. The pH was monitored during heating and kept at pH 7.15 with addition of dilute HCl. After the temperature of 49° C. was achieved, 0.1N NaOH was added to the test solution at a rate of 0.32 ml/min and the rise in pH was monitored. A decrease or plateau in the rate of pH increase is observed when calcium carbonate starts to precipitate, and is termed the critical pH. The critical pH for the test solution is shown in Table 2 columns 3 and 4 below along with the total milliequivalents per liter of hydroxide (as NaOH) added to reach the critical pH.

It is generally accepted that for effective scale inhibition, values of at least 1.5 milliequivalents of NaOH and a critical pH of greater than 8.5 are required.

The results provided in Table 2 demonstrate that the polytartaric acids of this invention would not be considered effective scale inhibitors.

TABLE 2

Corrosion and Scale Inhibition with Polytartaric Acid

| | | Corrosion Inhibition | Scale Inhibition | |
|---|---|---|---|---|
| Mw | $\bar{n}$ | mpy at 80 ppm | Millequiv. NaOH | Critical pH |
| 0 (blank) | 0 | 27.0 | 0.48 | 7.69 |
| 194 | 1 | 19.4 | 0.55 | 7.74 |
| 265 | 1.4 | 12.6 | 1.04 | 8.22 |
| 335 | 1.8 | 15.0 | 1.06 | 8.40 |
| 390 | 2.0 | 14.5 | — | — |
| 530 | 2.9 | 20.5 | 1.35 | 8.46 |
| 731 | 4.0 | 32.3 | 1.48 | 8.47 |

EXAMPLE 7

The procedure of Example 4 was repeated, except that β-methyl-cis-epoxysuccinic acid was used in place of cis-epoxysuccinic acid. The product was analyzed by NMR, giving 9.8% by weight of poly(tartaric/methyltartaric) acid. This product was tested for corrosion inhibition using the procedure of Example 6, giving 13.9 mpy versus 19.0 mpy for methyltartaric acid and 27.0 mpy for a blank.

EXAMPLE 8

The polytartaric acids of this invention were evaluated as corrosion inhibitors using polarization resistance techniques. Cylindrical 1010 mild steel coupons, 600 grit finish, were prepared by degreasing in hexane, washing in a soapy water solution, and then rinsing in acetone. This cleaning process was conducted in an ultrasonic bath. The coupons were then immersed in an electrolyte solution having the following composition:

| | |
|---|---|
| $CaCl_2 \cdot 2H_2O$ | 101.76 ppm |
| $MgSO_4 \cdot 7H_2O$ | 671.4 ppm |
| $CaSO_4 \cdot 2H_2O$ | 664.2 ppm |
| $NaHCO_3$ | 529.2 ppm |
| polyacrylic acid* | 5 ppm |

*molecular weight of approximately 2000

The pH of the electrolyte solution was adjusted to 8.5 and the temperature was maintained at 44° C. The electrolyte solution was kept in aeration condition. Polyacrylic acid was used to stabilize the electrolyte solution. The corrosion rates obtained when 0 ppm (control sample for comparison), 2 ppm, 5 ppm, 10 ppm or 30 ppm of polytartaric acid was added to the electrolyte solution.

The coupons were rotated in the electrolyte solution at 2 ft/s linear velocity. The potential of the electrode was scanned from −15 mV to 15 mV relative to the electrode's open circuit potential. The potential scanning rate was 0.2 mV/s. The responding current was plotted as the x-axis data and the applied potential was plotted as the y-axis data for the determination of polarization resistance.

The slope of the potential vs. current plot is defined as the polarization resistance:

$$Rp\ (\mathrm{K\Omega}) = \frac{E\ (\mathrm{mV})}{I\ (\mu\mathrm{A})}$$

The corrosion rate in unit of mpy is calculated as:

$$\text{Rate (mpy)} = \frac{(0.13)(E.W.) \cdot \beta a \cdot \beta c}{d \cdot (2.3)(\beta a + \beta c)A \cdot Rp}$$

$\beta a$: anodic Tafel slope; $\beta a$ = 100 mV/decade $\beta c$: cathode Tafel slope; $\beta c$ = 100 mV/decade $E.W.$: Equivalent weight; g.

$d$: density; g/cm$^3$ $A$: area; cm$^2$ $Rp$: polarization resistance; KΩ

Figure 2:
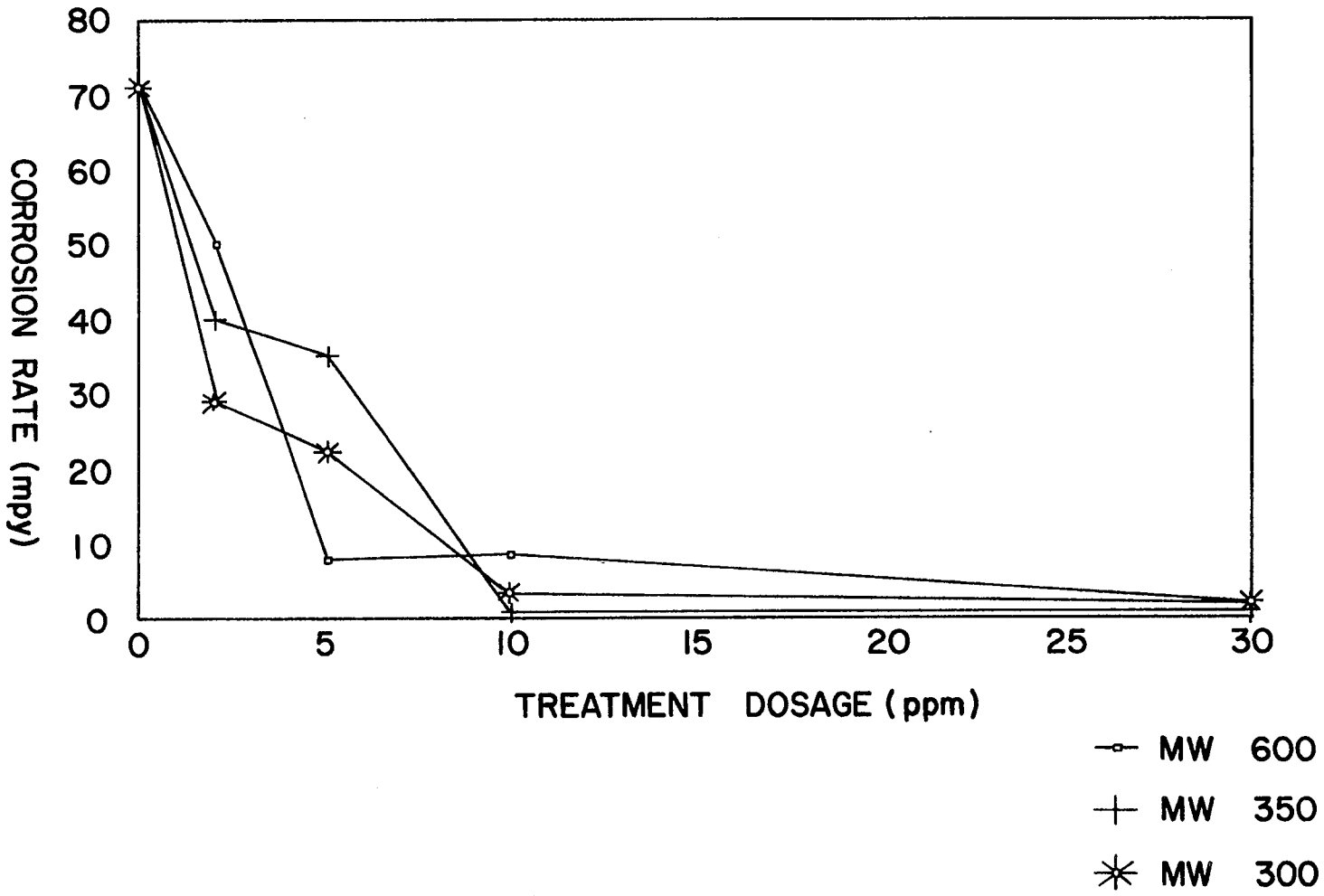
FIG. 2 shows the relative rates of corrosion inhibition of polytartaric acid of different molecular weight in high hardness water.

The results are illustrated in FIG. 2. The corrosion rates obtained using 3-Day Corrosion Rig are provided in Table 3. All the experimental conditions were identical with FIG. 2 except that the flow was adjusted to 20 cm/s and the coupons were treated with 3 times the maintenance dosage for pre-passivation. The corrosion rates were obtained using weight loss method.

TABLE 3

MPY Values of the 3 Day Corrosion Inhibition Rig Test Dosage Profile

Conditions:
44°
pH 8.5
6X CTW with 3X $NaHCO_3$
Flow Rate is 20 cm/sec
Dosage profile 2, 5, 10, 30 ppm active in feedwater and 3X passivation (in basin)

Results

| Treatment | 2 ppm | ppm | 10 ppm | 30 ppm |
|---|---|---|---|---|
| Mucic Acid | 15.37 | 13.57 | 14.04 | 3.59 |
| Meso Tartaric Acid | 25.06 | 20.76 | 17.13 | 4.07 |
| Polytartaric Acid | 8.28 | 4.60 | 4.53 | 4.43 |
| L-Tartaric Acid | 10.26 | 7.17 | 5.83 | 4.86 |

Blank: 5 ppm Active polyacrylic acid having a molecular weight of 2000: 29.34 MPY

EXAMPLE 9

The test for calcium insensitivity of a compound, as used in this example, involves a cloud point test (hereinafter the CA500 cloud point test) where a polytartaric acid sample is added to hard water containing 500 ppm calcium ion (as $CaCO_3$) which was buffered at pH 8.3 using 0.005M borate buffer and which had a temperature of 60° C. The amount of polytartaric acid which can be added to the solution until it becomes turbid (the cloud point) is considered to be an indicator of calcium insensitivity. The results are provided in Table 4.

TABLE 4

| Calcium Sensitivity of Polytartaric Acid Samples | | | | | | | |
|---|---|---|---|---|---|---|---|
| | | Percent by Weight of Different Oligomers | | | | | |
| Mw(±10%) | $\bar{n}$ | Monomer | Dimer | Trimer | Tetramer | >Tetramer | Calcium Sensitivity Cloud pt (ppm) |
| 194 | 1 | 100% | 0 | 0 | 0 | 0 | >100 |
| 265 | 1.4 | 51 | 32 | 6 | 1 | 0 | >100 |
| 335 | 1.8 | 42 | 34 | 19 | 5 | 0 | >100 |
| 530 | 2.9 | 23 | 23 | 27 | 25 | 3 | >100 |
| 731 | 4 | 9 | 7 | 7 | 40 | 37 | 54 |

EXAMPLE 10

A synergistic polytartaric acid/polyacrylic acid corrosion inhibiting combination was demonstrated in a stirred beaker corrosion test.

Test water solutions containing 110.4 ppm calcium sulfate dihydrate, 17 ppm calcium chloride dihydrate, 111.5 ppm magnesium sulfate heptahydrate and 175 ppm sodium bicarbonate with various amounts of inhibitors were heated at 55° C. and pH adjusted to 8.5 with NaOH(aq). Clean preweighed SAE 1010 mild steel coupons (4.5 in.×0.5 in.) were immersed in 2 l of test solutions which were stirred with magnetic stirrer (350 rpm). The mild steel specimens were removed after 24 hrs beaker test, cleaned and reweighed to determine weight loss. The corrosion rates, expressed in mils (thousands of an inch) per year (mpy) were obtained from these weight losses (Table 5).

TABLE 5

| Polytartaric Acid/Polyacrylic Acid Corrosion Inhibition | | |
|---|---|---|
| Inhibitors (ppm) | | Corrosion Rate |
| Polytartaric Acid | Polyacrylic* Acid | (mpy) |
| 0 | 0 | 96.2 |
| 40 | 0 | 7.4 |
| 30 | 10 | 3.1 |
| 0 | 40 | |

*molecular weight of about 2000

EXAMPLE 11

This example illustrates the synergistic effect of azoles on polytartaric acid/polyacrylic acid corrosion inhibiting combination described in Example 10.

Test water was prepared with 662.5 ppm calcium sulfate dihydrate, 102 ppm calcium chloride dihydrate, 669 ppm magnesium sulfate heptahydrate and 350 ppm sodium bicarbonate. Stock solutions of azoles were prepared by dissolving 0.01M azole in deionized water and adjusting to pH ~12 prior to addition to 2 l of test water containing small amounts of polytartaric and polyacrylic acids. Degreased mild steel coupons were preweighed before being introduced into the test water solution which had been heated to 55° C. (pH ~8.5). After the 24 hour corrosion test, the specimens were cleaned, dried and weighed to determine the weight losses. The corrosion rates (mpy) are calculated for different polytartaric acid/azole ratio (Table 6).

TABLE 6

| Polytartaric Acid/Polyacrylic Acid/ Azole Corrosion Inhibition | | | |
|---|---|---|---|
| Inhibitors (ppm) | | | Corrosion |
| Polytartaric Acid | Polyacrylic* Acid | Azole** | Rate (mpy) |
| 0 | 0 | 0 | 38.8 |

TABLE 6-continued

| Polytartaric Acid/Polyacrylic Acid/ Azole Corrosion Inhibition | | | |
|---|---|---|---|
| Inhibitors (ppm) | | | Corrosion |
| Polytartaric Acid | Polyacrylic* Acid | Azole** | Rate (mpy) |
| 80 | 5 | 0 | 13.2 |
| 76 | 5 | 4 | 15.8 |
| 65 | 5 | 15 | 9.0 |
| 0 | 5 | 80 | 14.2 |

*molecular weight of about 2000
**5-carboxybenzotriazole

EXAMPLE 12

An 80 g sample of polytartaric acid (MW=280), prepared as described in Example 4 was diluted with 150 ml of water and mixed with 440 g of strong acid ion exchange resin (Dowex). The pH of the mixture was 1.9. This was stirred for 15 minutes, then filtered to give 200 ml of solution. The pH of this solution was adjusted to 2.5 with NaOH (50%, aq.). While stirring the solution, 800 ml of methanol was added. The stirring was continued for 1 hour, then the solid was collected by filtration. This solid was re-dissolved in about 40 ml of water and the pH was adjusted to 12–13. Analysis by gel permeation chromatography showed the solution to be 5.8% ditartaric acid (n=2, Mw =390), with very little tartaric acid and tritartaric acid.

This sample of ditartaric acid was tested for corrosion inhibition, using the procedure in Example 6. It gave a corrosion rate of 14.5 mpy (compare to the results in Table 2).

EXAMPLE 13

The procedure of Example 10 was repeated with L-tartaric acid and polytartaric acid (molecular weight 700) as inhibitors. At the end of the test, the steel coupon from the test with L-tartaric acid was severely pitted (approximately 300 small pits) while the steel coupon from the polytartaric acid test was not pitted.

We claim:

1. A method for inhibiting corrosion of metals in contact with an aqueous solution comprising adding to the system a corrosion inhibiting amount of one or more polytartaric acids having the formula:

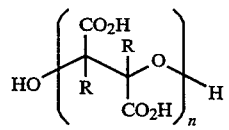

wherein n is less than 4; the average molecular weight of the polytartaric acids corresponds to an average n in the range 1.2 to 3, and wherein each R is independently selected from the group consisting of H and $C_1$ to $C_4$ alkyl or a water soluble salt thereof.

2. A method according to claim 1 wherein the polytartaric acid is added to the aqueous system in combination with second water-soluble treating component selected from the group consisting of a tartaric acid, a phosphate, a phosphonate, a polyacrylate, an azole and mixtures thereof.

3. A method according to claim 2 wherein the combination of the polytartaric acid and tartaric acid, phosphate, phosphonate, a polyacrylate, an azole or mixture thereof are in a weight ratio on an actives basis, in the range of from 1:10 to 20:1, respectively.

4. A method according to claim 2 wherein the combination of the polytartaric acid and tartaric acid, phosphate, phosphonate, a polyacrylate, an azole or mixture thereof are in a weight ratio, on an actives basis, in the range of from 2:1 to 10:1, respectively.

5. A method according to claim 1 wherein the average n is from 1.4 to 2.

6. A method according to claim 5 wherein the water soluble salt is a sodium salt.

7. A method according to claim 1 wherein the amount of polytartaric acid added to the system is from 0.01 to 500 ppm.

8. A method according to claim 1 wherein the amount of polytartaric acid added to the system is from 0.1 to 100 ppm.

9. A method according to claim 1 wherein the amount of polytartaric acid added to the system is from 0.5 to 50 ppm.

10. A method according to claim 1 wherein n is 2.

11. A method according to claim 1 wherein the polytartaric acid is added to the system in combination with a second water-treating component selected from the group consisting of scale inhibitors, biocides, chelants, sequestering agents, polymeric agents, and mixtures thereof.

12. A method according to claim 1 wherein the water soluble salt is a sodium salt.

* * * * *